US007736119B2

(12) United States Patent
Belik

(10) Patent No.: US 7,736,119 B2
(45) Date of Patent: Jun. 15, 2010

(54) HORIZONTAL PIPE HANDLING SYSTEM

(75) Inventor: Jaroslav Belik, Perarland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 162 days.

(21) Appl. No.: 11/458,527

(22) Filed: Jul. 19, 2006

(65) Prior Publication Data

US 2007/0031215 A1 Feb. 8, 2007

Related U.S. Application Data

(60) Provisional application No. 60/700,624, filed on Jul. 19, 2005.

(51) Int. Cl.
*B66F 11/00* (2006.01)
*E21B 19/00* (2006.01)

(52) U.S. Cl. ..... 414/745.9; 414/22.62

(58) Field of Classification Search ... 414/22.54–22.62, 414/745.1, 745.3, 745.7, 745.8, 745.9, 746.1, 414/746.2, 746.4, 746.6; 405/184; 132/45; 198/463.5
See application file for complete search history.

(56) References Cited

U.S. PATENT DOCUMENTS

| | | | | | |
|---|---|---|---|---|---|
| 278,022 | A * | 5/1883 | Kline | 414/743 |
| 845,152 | A * | 2/1907 | Weir | 83/722 |
| 2,631,741 | A * | 3/1953 | Tucker | 414/22.61 |
| 2,710,104 | A * | 6/1955 | Putnam | 414/198 |
| 3,182,816 | A * | 5/1965 | Illo | 414/746.4 |
| 3,559,821 | A * | 2/1971 | James | 414/22.61 |
| 3,706,347 | A * | 12/1972 | Brown | 175/85 |
| 3,734,208 | A * | 5/1973 | Otto | 175/52 |
| 3,734,210 | A | 5/1973 | Wilderman | |
| 3,792,783 | A * | 2/1974 | Brown | 414/22.62 |
| 3,916,500 | A * | 11/1975 | Brown | 29/240 |
| 3,985,221 | A * | 10/1976 | Lueders | 198/463.5 |
| 4,051,956 | A * | 10/1977 | Teague | 414/746.4 |
| 4,494,899 | A * | 1/1985 | Hoang et al. | 414/22.61 |
| 4,533,055 | A * | 8/1985 | Haney | 211/70.4 |
| 4,642,017 | A * | 2/1987 | Fenn | 414/348 |
| 5,887,816 | A * | 3/1999 | Jones | 242/420.6 |
| 2002/0098073 | A1 * | 7/2002 | Drei et al. | 414/746.2 |
| 2006/0045655 | A1 | 3/2006 | Wells | |
| 2006/0060382 | A1 | 3/2006 | Sewell et al. | |

FOREIGN PATENT DOCUMENTS

| | | |
|---|---|---|
| WO | 200151762 A1 | 7/2001 |

OTHER PUBLICATIONS

EP Patent Application S/N 07118892.4 Search Report dated Mar. 28, 2008.

(Continued)

*Primary Examiner*—Gregory W Adams
(74) *Attorney, Agent, or Firm*—Conley Rose, P.C.

(57) ABSTRACT

A pipe handling system comprises a pipe rack moveably coupled to a stationary frame. The pipe rack is configured to support a plurality of pipes between a loading end and a storage end. The pipe rack is moveable between a loading position where the loading end is positioned at a higher elevation than the storage end and an unloading position wherein the storage end is positioned at a higher elevation than the loading end. An arm is rotatably coupled to the loading end of the rack and is configured to engage a single pipe and move the single pipe onto or off of the pipe rack.

24 Claims, 14 Drawing Sheets

OTHER PUBLICATIONS

EP Patent Application S/N 07118892.4 Office Action dated May 15, 2009.

Canadian Patent Application S/N 2,606,987 Office Action dated May 15, 2009.

* cited by examiner

HORIZONTAL PIPE HANDLING SYSTEM

CROSS-REFERENCE TO RELATED APPLICATIONS

This application claims priority to U.S. Provisional Patent Application No. 60/700,624, filed on Jul. 19, 2005 and titled "Single Joint Drilling System," which is hereby incorporated by reference herein.

STATEMENT REGARDING FEDERALLY SPONSORED RESEARCH OR DEVELOPMENT

Not Applicable.

BACKGROUND

The present invention relates generally to methods and apparatus for drilling wells. More specifically, the present invention relates to systems for drilling wells utilizing single joints of pipe.

Many smaller drilling rigs store tubular members, such as drill pipe, drill collars, and casing, in horizontal storage areas outside of the rig. As the different tubular members are needed, they are brought to the drill floor one at a time and added to the string. Handling these tubular members has historically been a highly manual job using winches or other lifting appliances within the rig. Automated systems for use in these "single joint" rigs must be able to safely handle a variety of tubular members while not slowing down drilling or tripping processes.

One important step in the pipe handling process is manipulating pipe and other tubular members in the horizontal storage areas before they are moved to the drilling rig. In many operations, horizontal pipes aye manipulated using forklifts or other manually-operated lifting devices. These manual systems limit the efficiency of the overall system and also often place workers in areas where heavy loads are being moved, thus creating safety concerns. Thus, there remains a need to develop methods and apparatus for pipe handling and drilling systems, which overcome some of the foregoing difficulties while providing more advantageous overall results.

SUMMARY OF THE PREFERRED EMBODIMENTS

Embodiments of the present invention include a pipe handling system comprising a pipe rack moveably coupled to a stationary frame. The pipe rack is configured to support a plurality of pipes between a loading end and a storage end. The pipe rack is moveable between a loading position where the loading end is positioned at a higher elevation than the storage end and an unloading position wherein the storage end is positioned at a higher elevation than the loading end. An arm is rotatably coupled to the loading end of the rack and is configured to engage a single pipe and move the single pipe onto or off of the pipe rack.

Thus, the embodiments of present invention comprise a combination of features and advantages that enable substantial enhancement of moving pipe and other tubular members to and from a drilling rig. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1A:
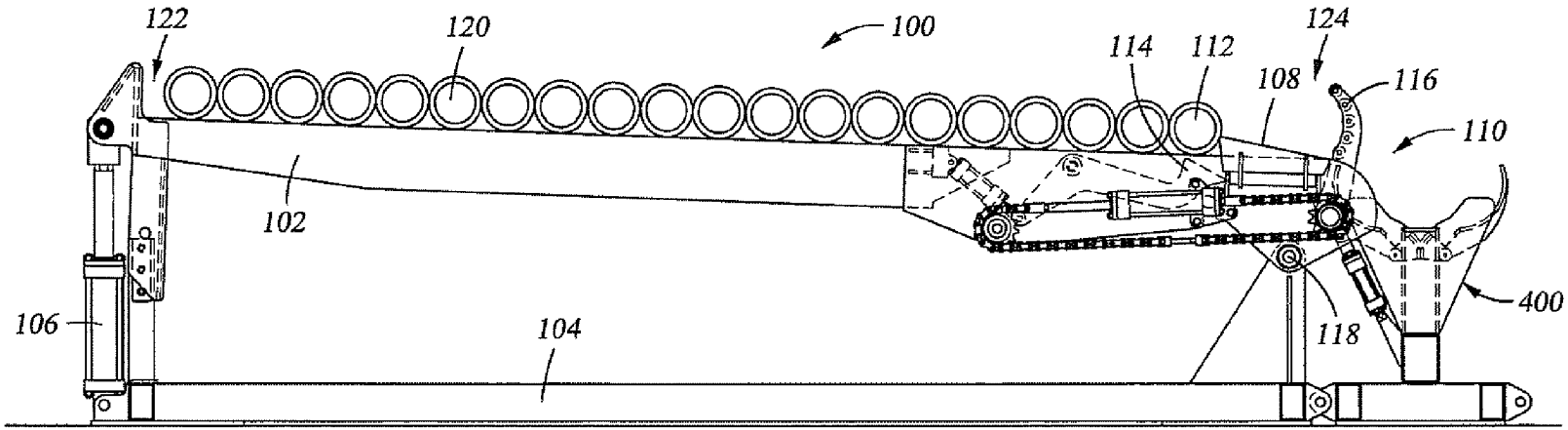
FIGS. 1A-F illustrate the loading of pipe from a pipe handling system constructed in accordance with embodiments of the invention.

Referring now to FIG. 1A, pipe handling system 100 comprises rack 102, frame 104, tilting mechanism 106, elevated stop 108, and pipe unloading assembly 110. Unloading assembly 110 comprises lifting block 114 and rotating arm 116. Rack 102 is moveably coupled to frame 104 at pivot 118. A plurality of pipes 120 are stored on rack 102 between storage end 122 and loading end 124. Tilting mechanism 106 is coupled to frame 104 and rack 102 so as to control the height of storage end 122 of rack 102 relative to loading end 124. By varying the height of storage end 122, gravity can be used to move the pipes 102 along rack 102. In certain embodiments, frame 104 may be coupled to erector system 400 so that pipe handling system 100 is transported with and operates as an integrated component of the erector system.

Figure 1B:
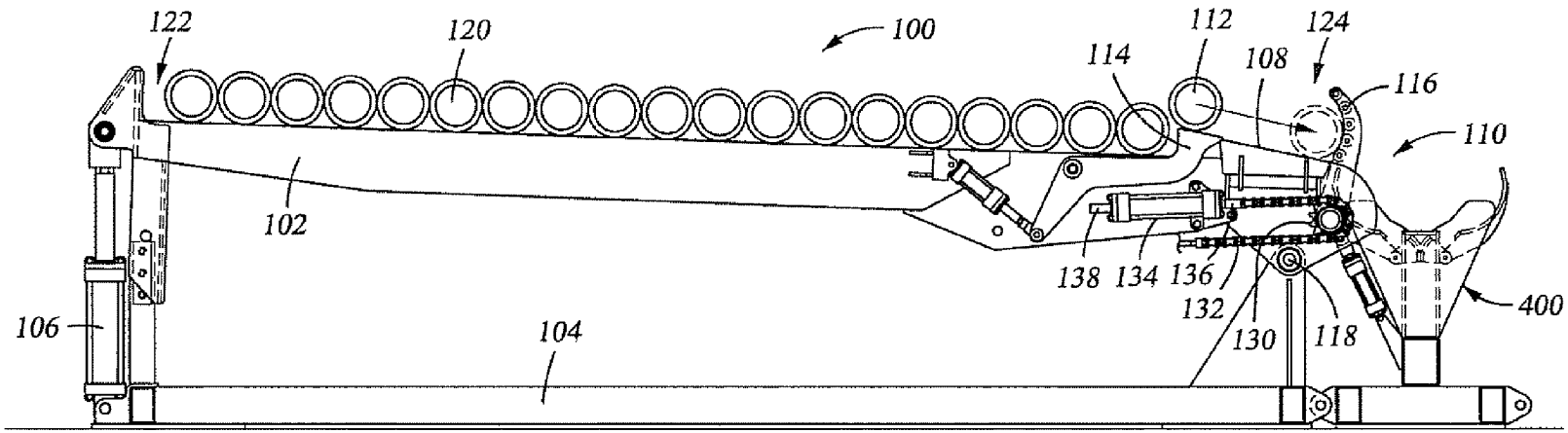
Figure 1C:
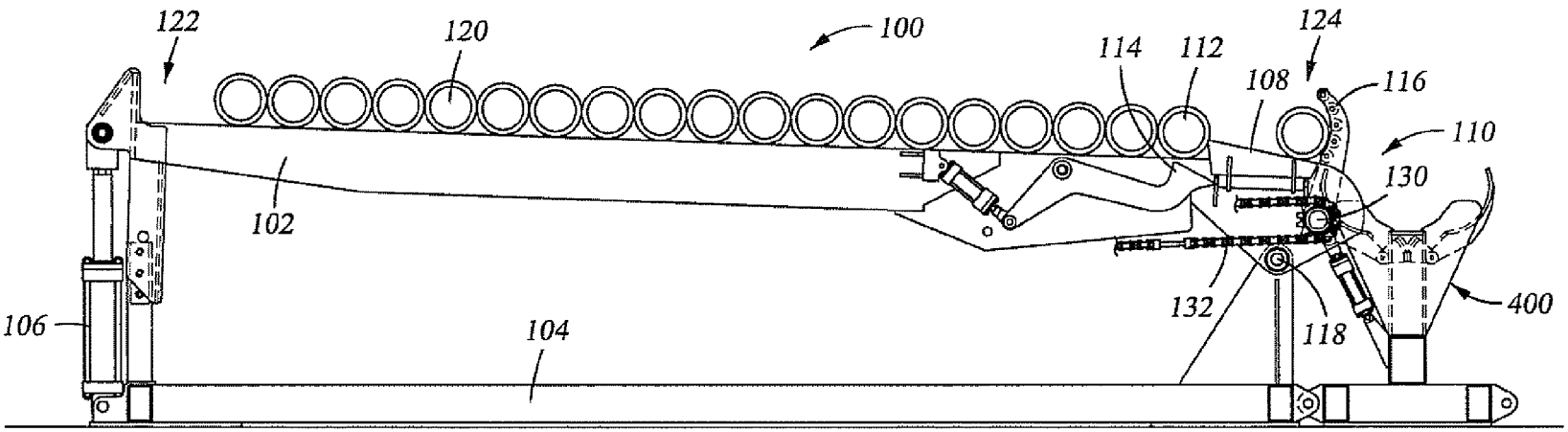

In FIG. 1A, rack 102 is in a loading position where storage end 122 is higher than loading end 124. Gravity will move pipes 112 along rack 102 toward loading end 124 until the pipes contact elevated stop 108. Referring now to FIG. 1B, to load a single joint of pipe 112 onto erector system 400, lifting block 114 is raised, pushing a single joint of pipe 112 upward. The pipe 112 moves over and past elevated stop 108 toward the end of rack 102. Lifting block 114 is then lowered so that the remainder of pipes 120 can move downward until contacting elevated stop 108.

Figure 1D:
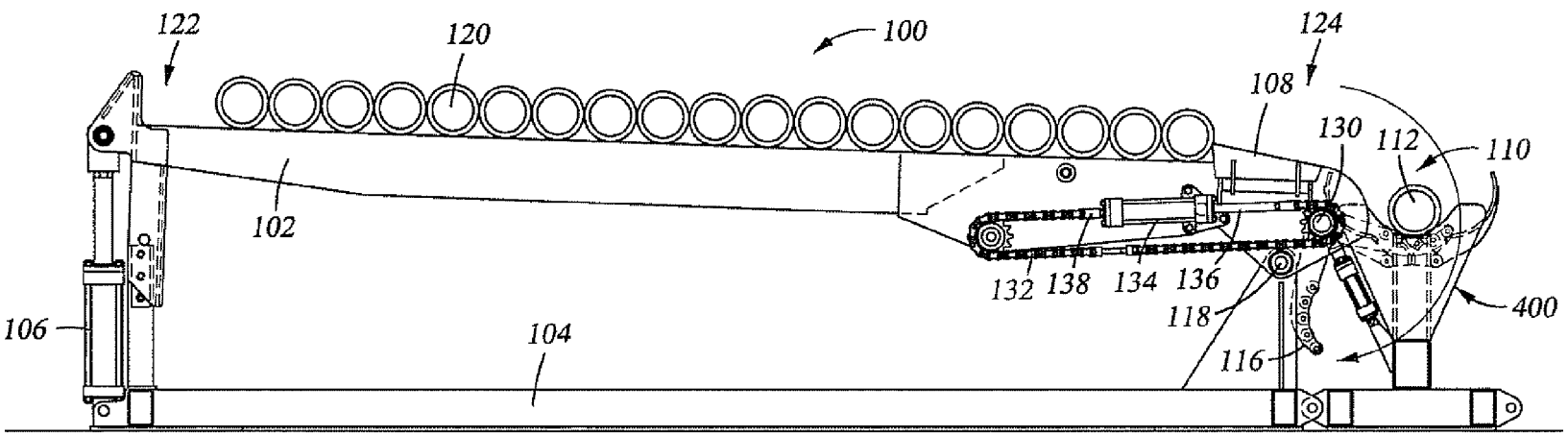
Figure 1E:
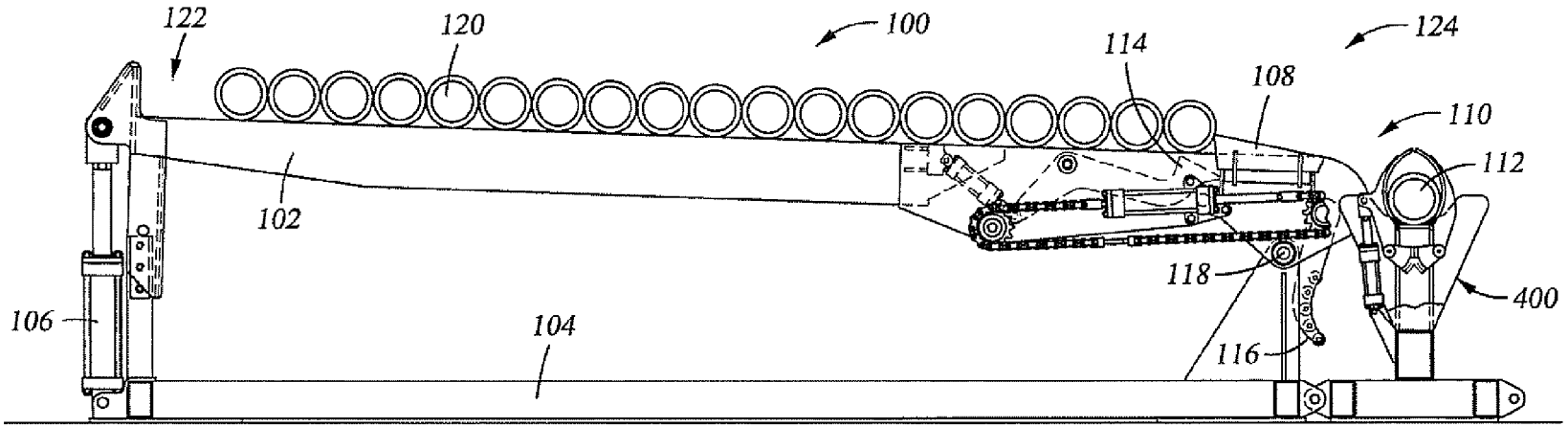
Figure 1F:
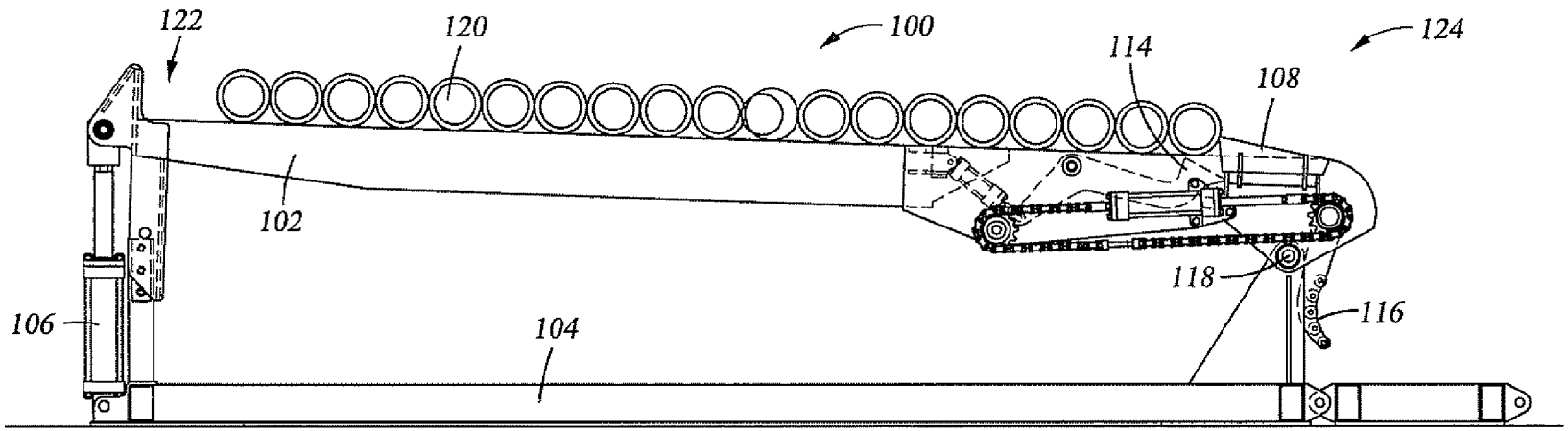
Figure 2A:
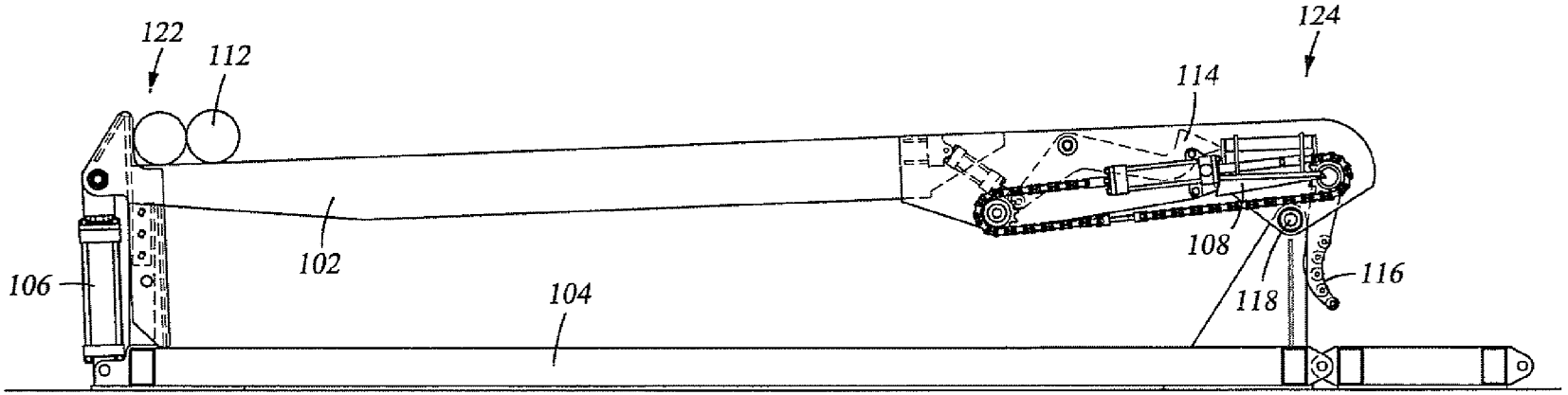
FIGS. 2A-F illustrate the loading of pipe onto the pipe handling system of FIGS. 2A-F.
Figure 2B:
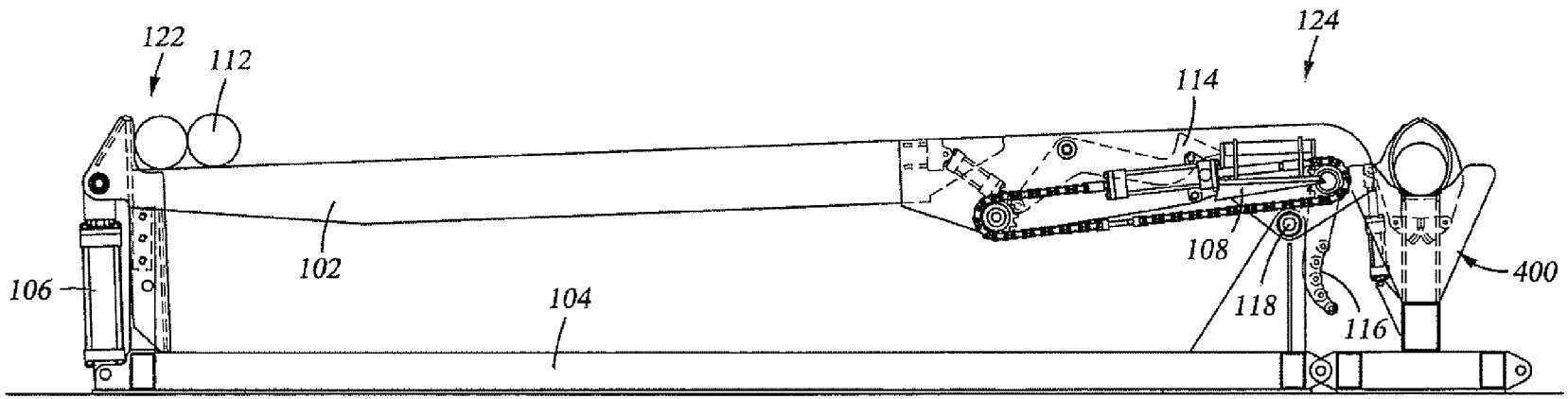
Figure 2C:
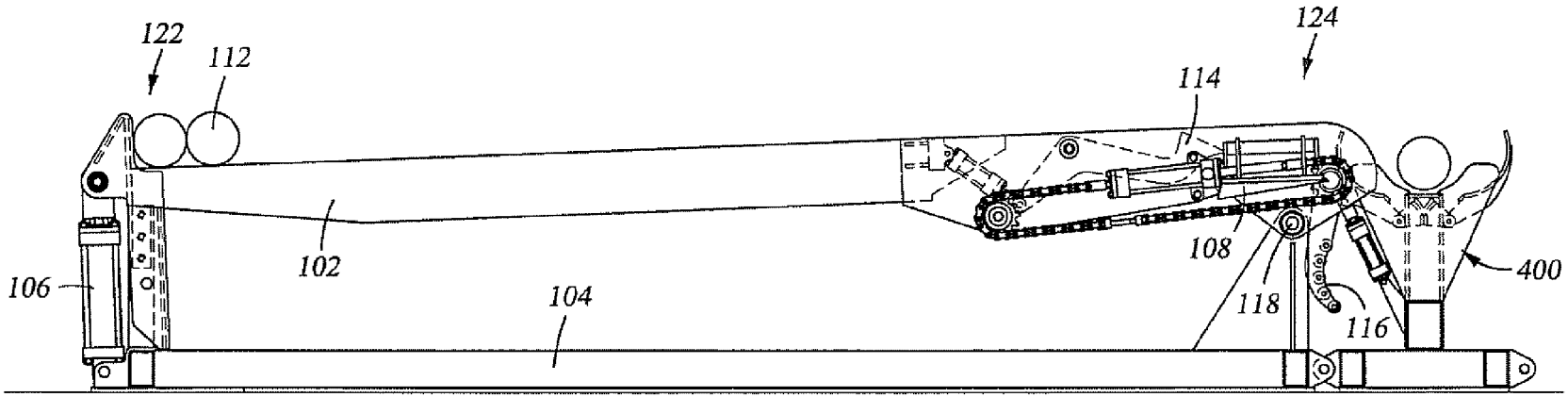
Figure 2D:
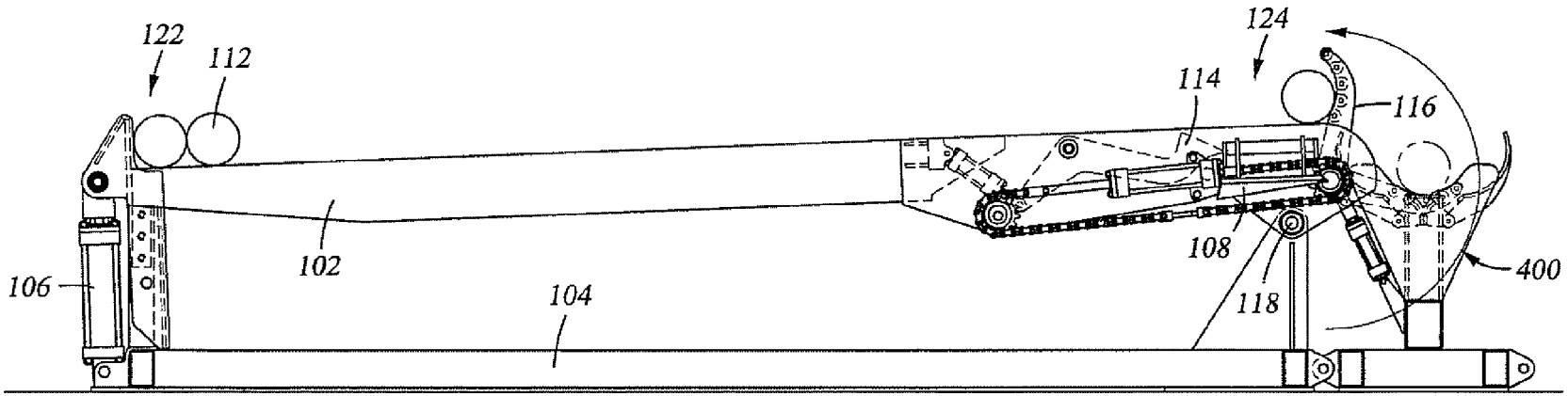
Figure 2E:
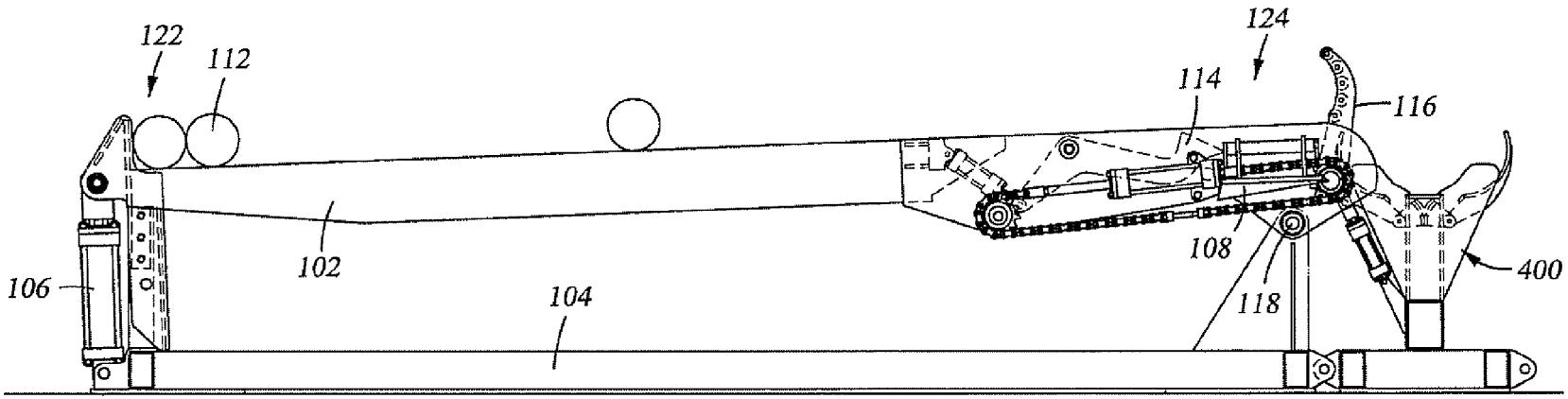
Figure 2F:
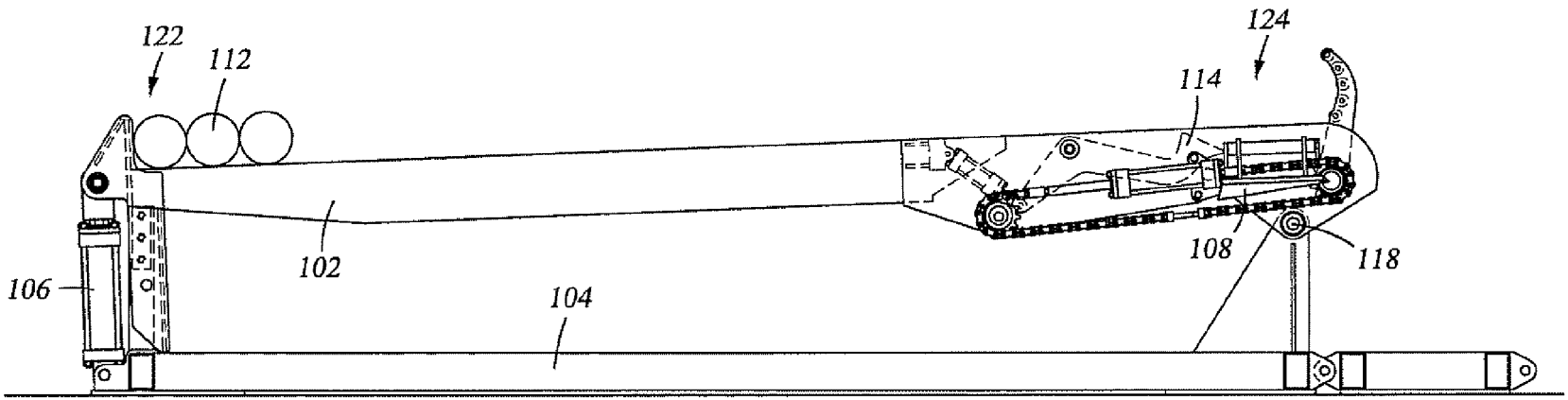

At the end of rack 102, pipe 112 is stopped by arm 116, which is disposed in a raised position. Arm 116 is coupled to gear 130 on which is mounted chain 132. Chain 132 is coupled to each end of double-acting linear actuator 134, which is coupled to rack 102. As rod 136 of linear actuator 134 is extended and rod 138 is retracted, gear 130 and arm 116 rotate. The rotation of arm 116 continues until pipe 112 is lowered onto erector system 400 as is shown in FIG. 1D. Arm 116 continues rotating downward so that is out of the way of erector system 400 as shown in FIG. 1E. Erector system 400 can then lift pipe 112 upward and away from pipe handling system 100.

FIGS. 2A-F illustrate pipe handling system 100 being used to store pipes being removed from a drill string. When moving pipes 112 from erector system 400, tilting mechanism 106 lowers the storage end 122 of rack 102 so as to angle the rack away from erector system 400. Lifting block 114 and elevated stop 108 are retracted into rack 102 so as to provide a smooth surface along which pipe 112 can roll. Once pipe 112 is lowered and released by erector system 400, arm 116 rotates upward so as to lift the pipe from the erector. Arm 116 continues to rotate until pipe 112 falls onto rack 102 where it will roll toward the far end of the rack.

Another pipe handling system is shown in FIGS. 3A-H and 4A-H. Pipe handling system 200 comprises frame 202 that is pivotally mounted on base 204. The incline of frame 202 is controlled by piston 206 to that the relative heights of storage end 221 and loading end 222 of frame 202 can be adjusted. The loading and unloading of pipe into handling system 200 is done by pipe moving assembly 210. Pipe moving assembly 210 comprises extendable finger 214, rotatable arm 216, drive motor 218, and rotary motor 224. Assembly 210 is slidably mounted to a vertical member of frame 202 so that drive motor 218 engages gear rack 220.

Figure 3A:
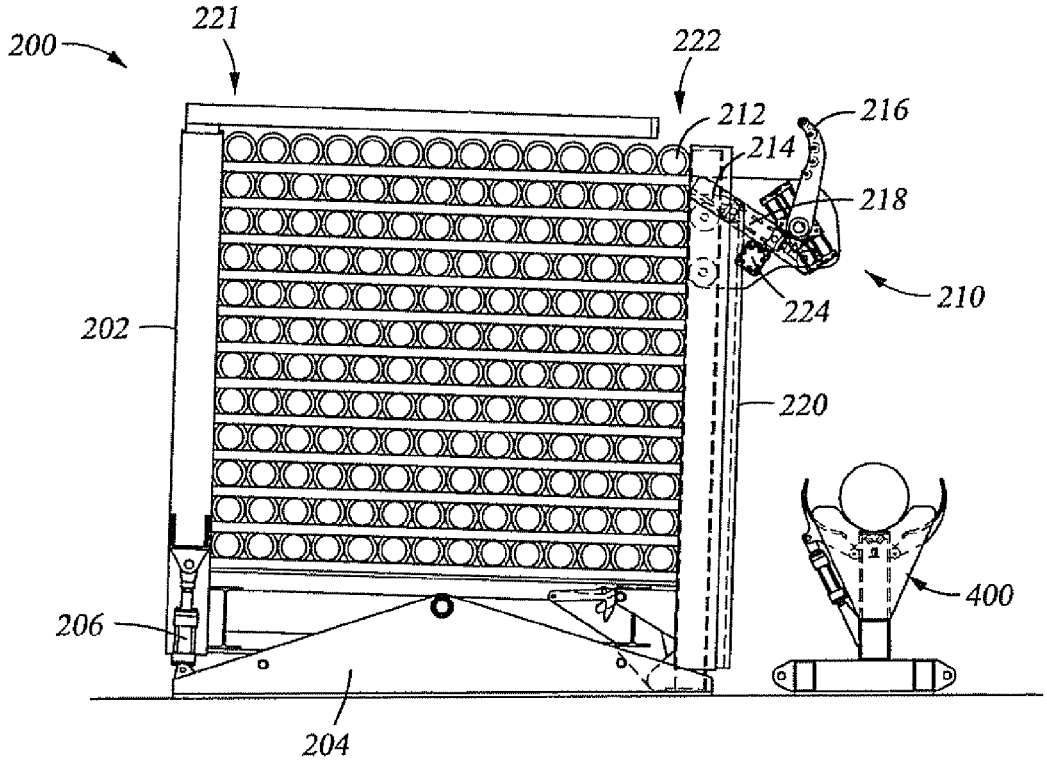
FIGS. 3A-H illustrate the loading of pipe from a pipe handling system constructed in accordance with embodiments of the invention.
Figure 3B:
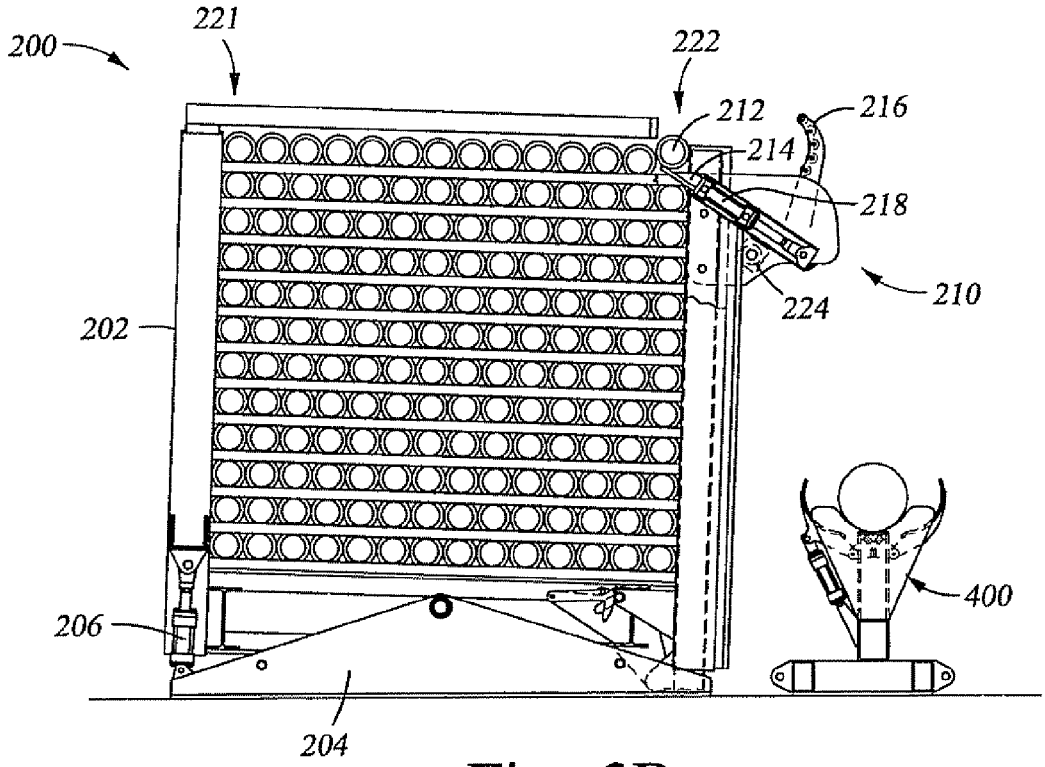
Figure 3C:
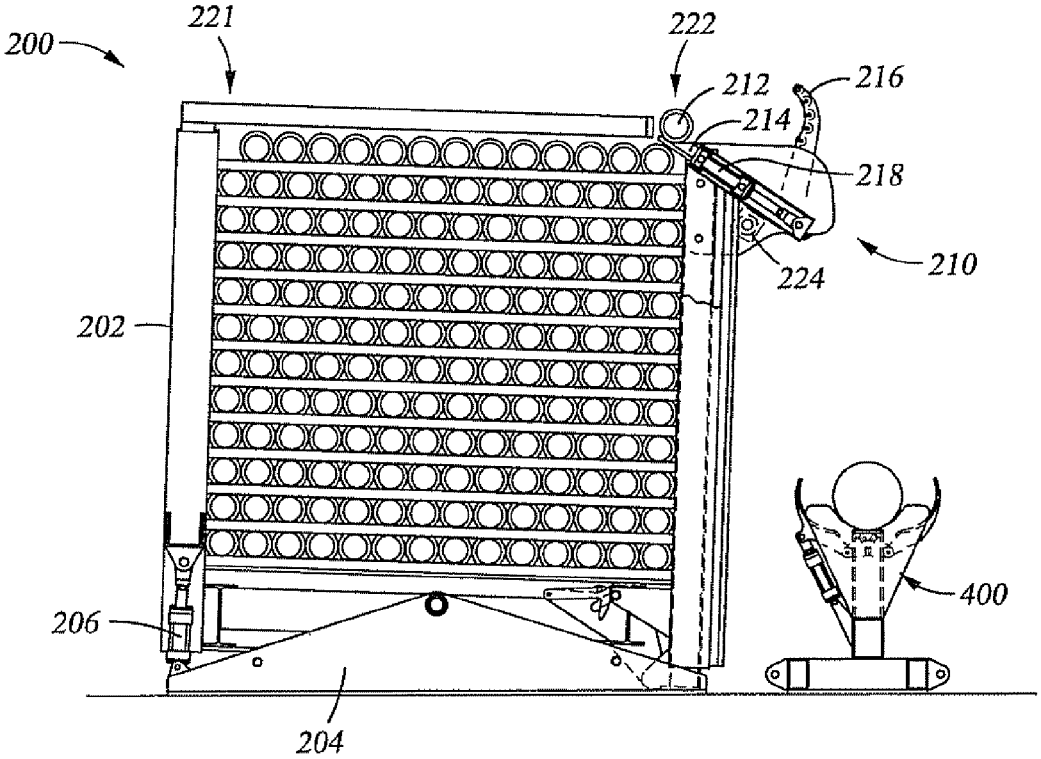
Figure 3D:
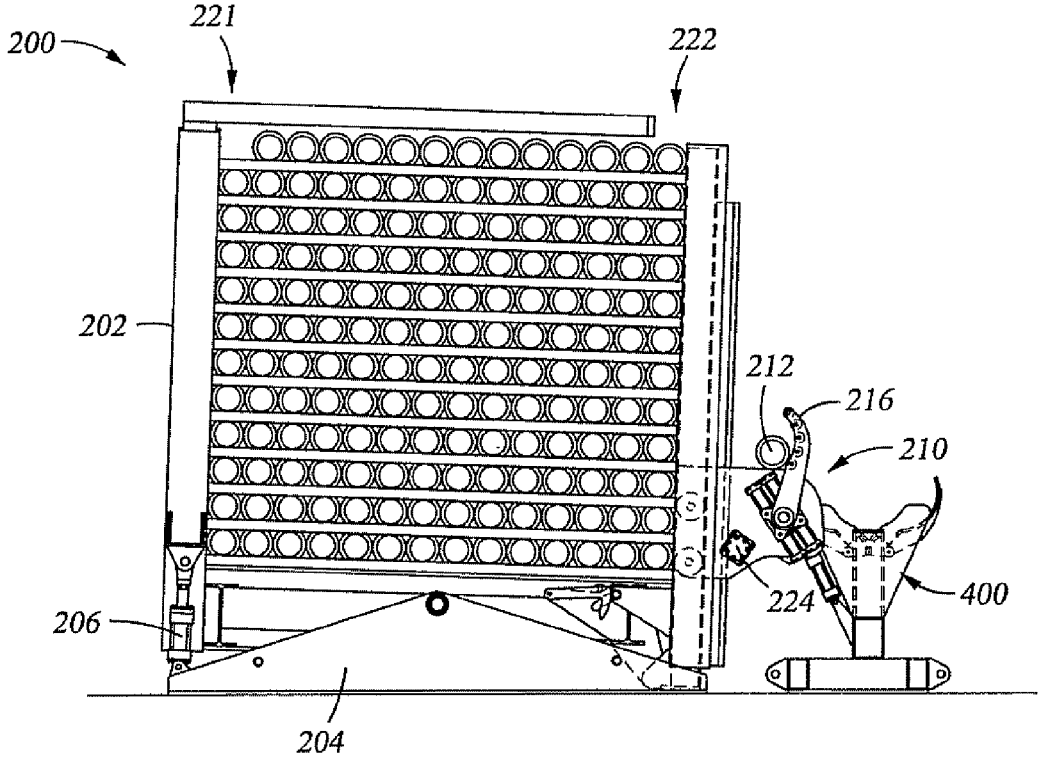
Figure 3E:
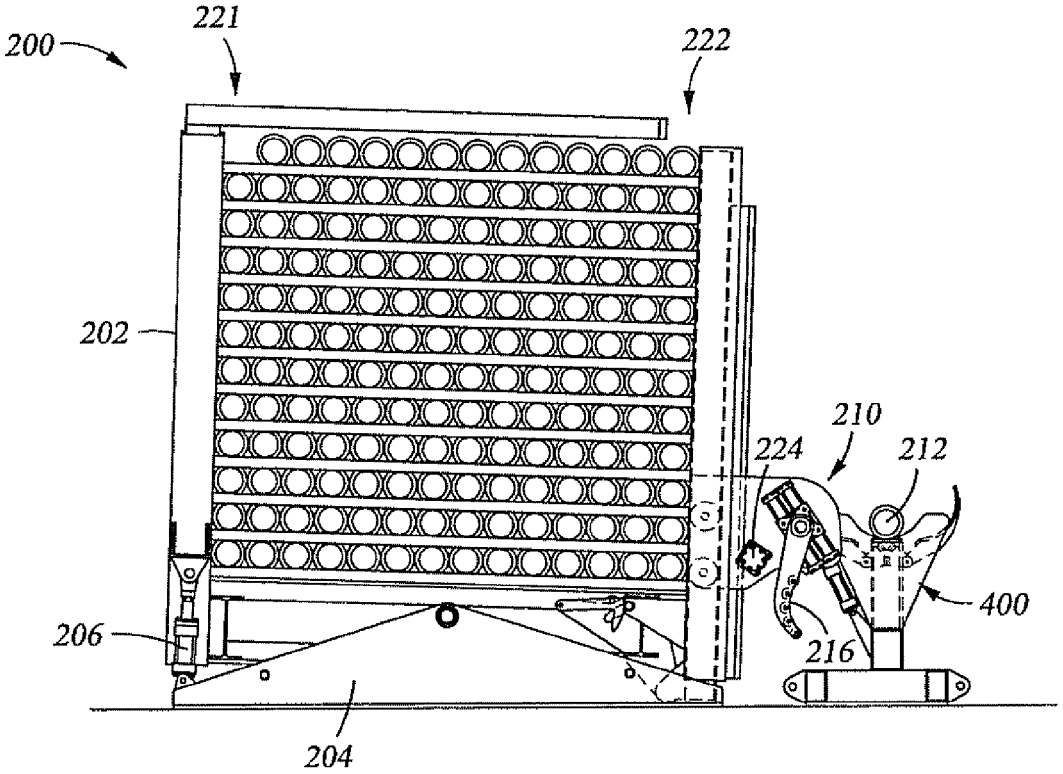
Figure 3F:
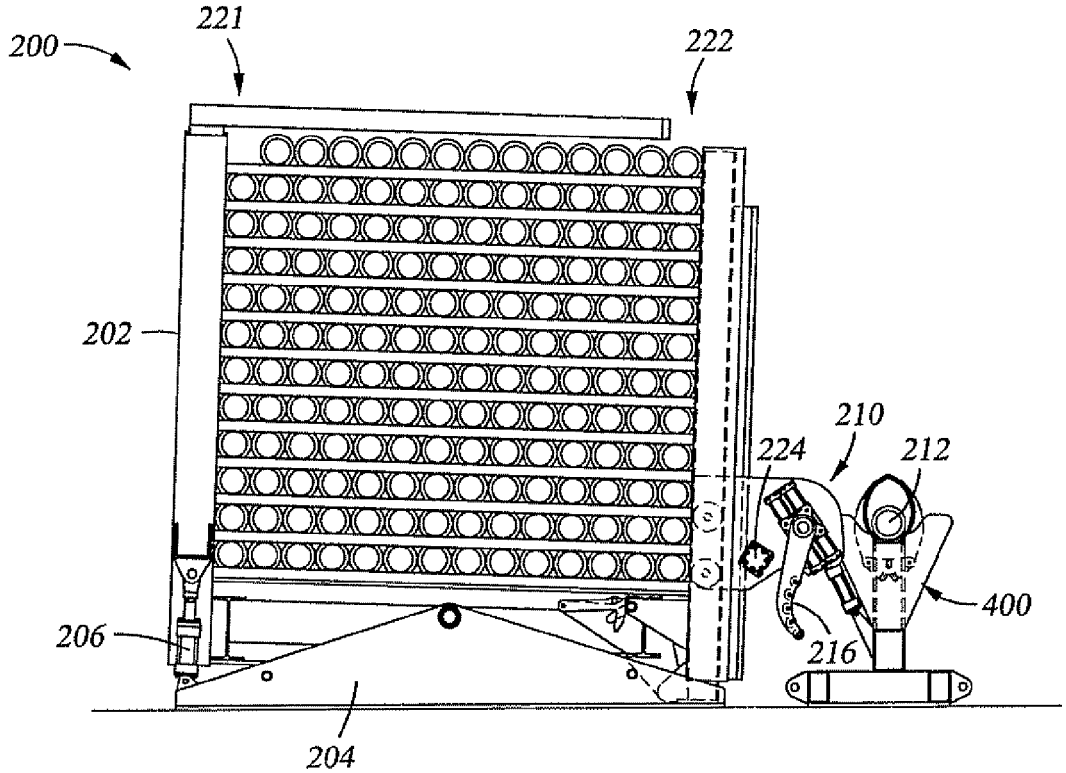
Figure 3G:
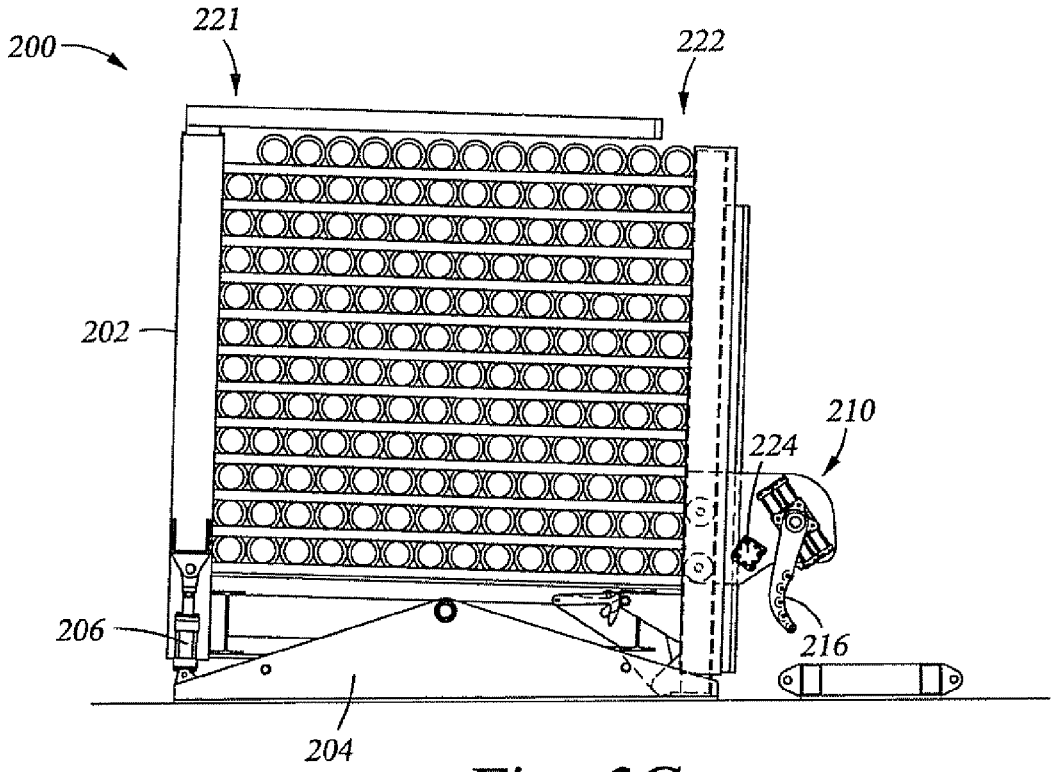
Figure 3H:
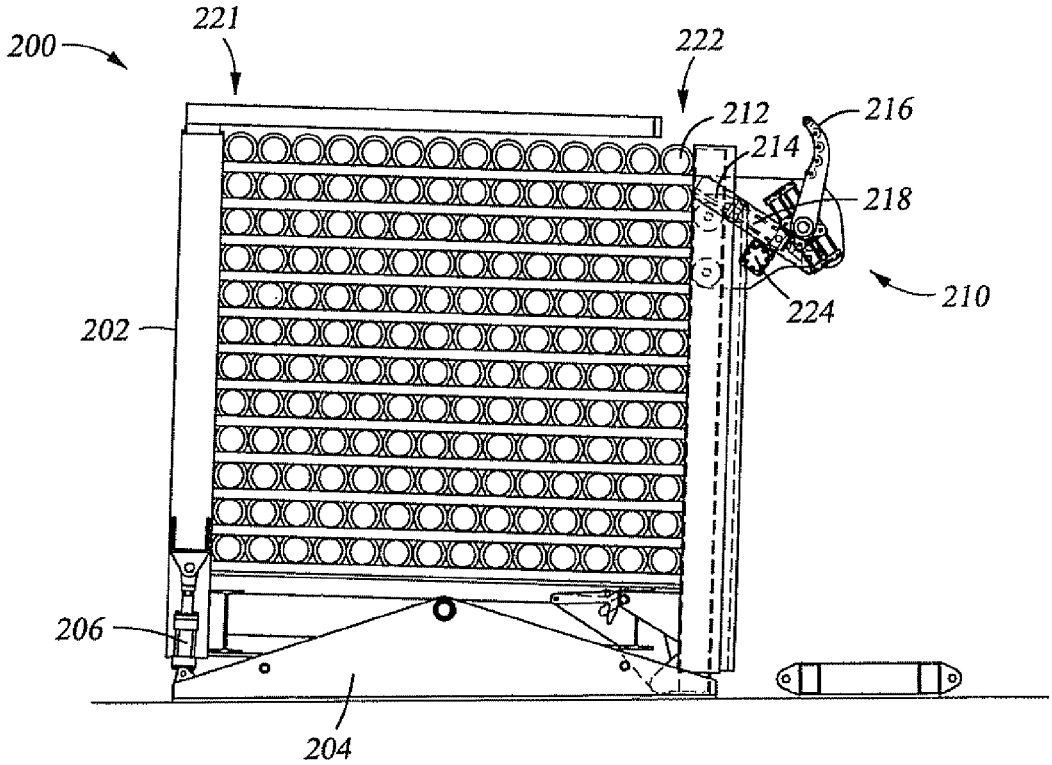
Figure 4A:
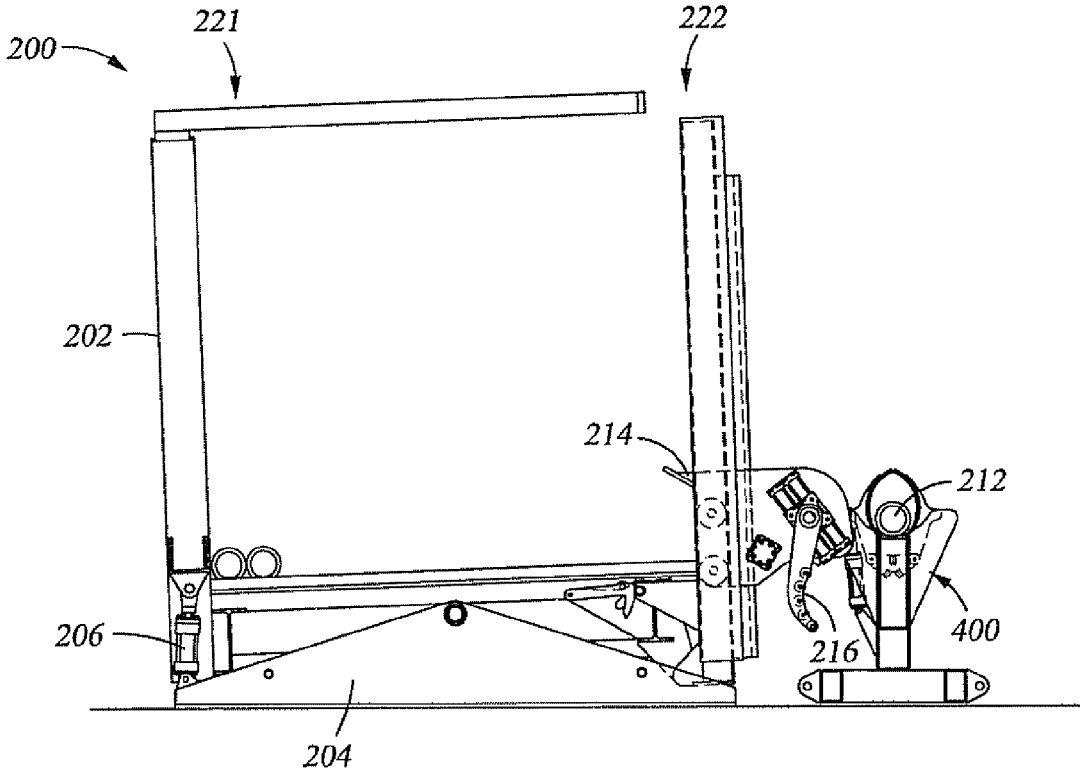
FIGS. 4A-H illustrate the loading of pipe onto the pipe handling system of FIGS. 3A-H.
Figure 4B:
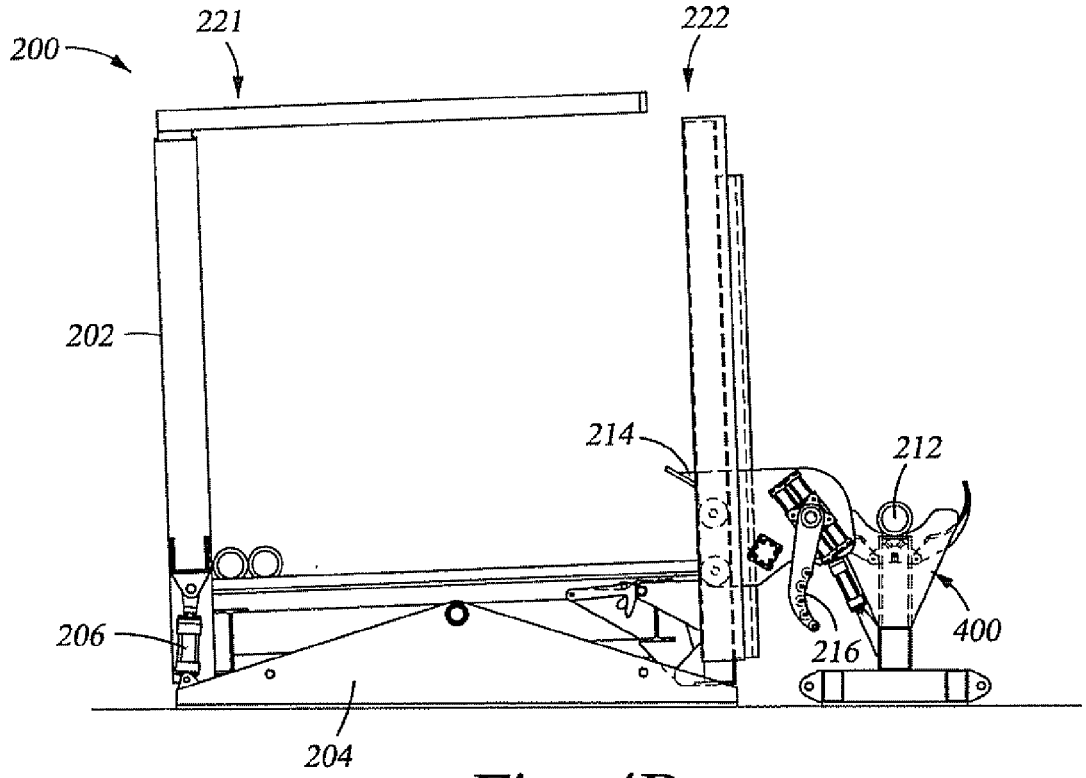
Figure 4C:
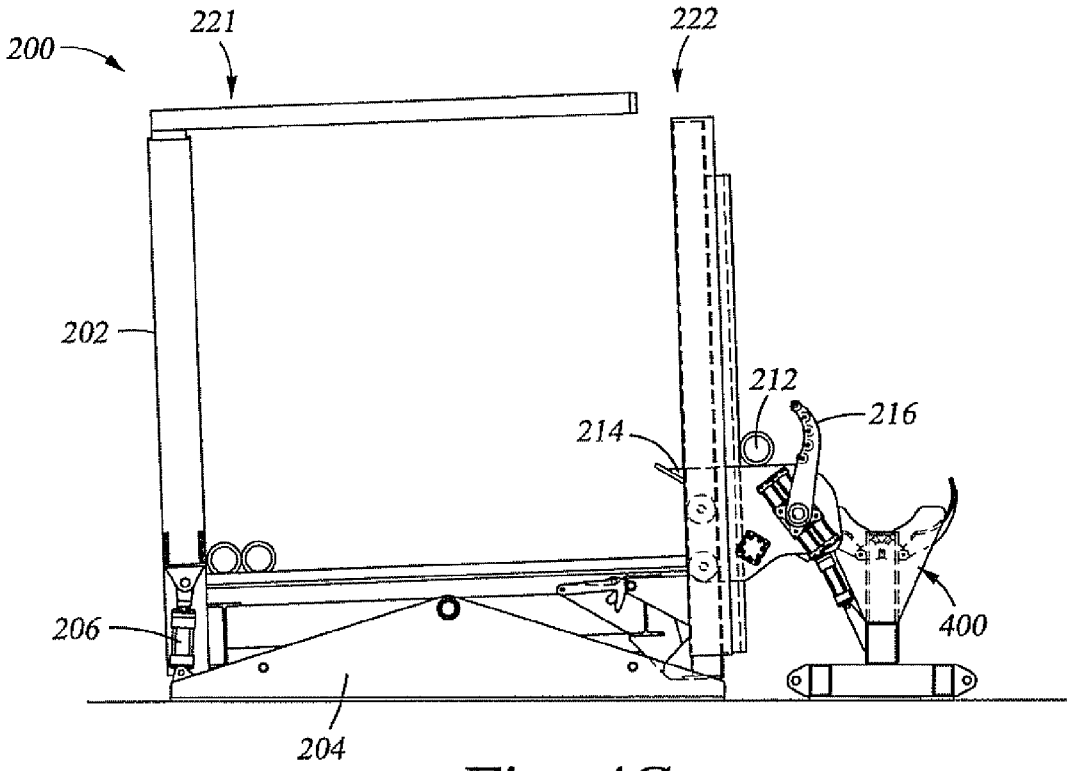
Figure 4D:
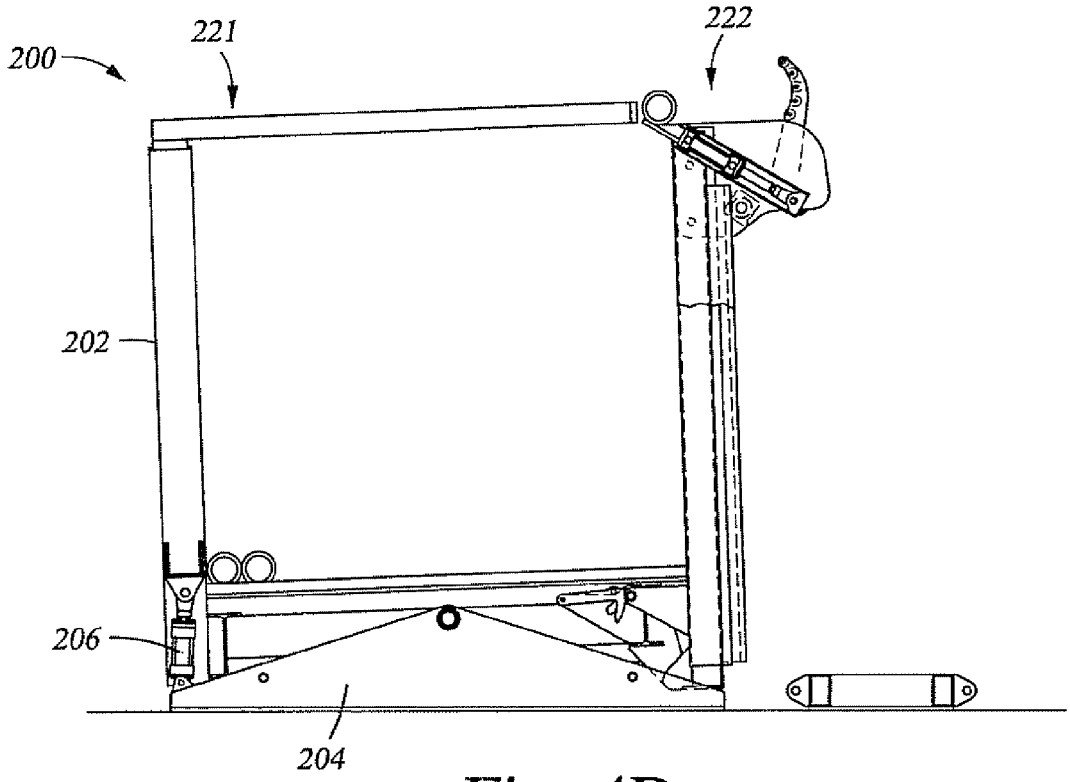
Figure 4E:
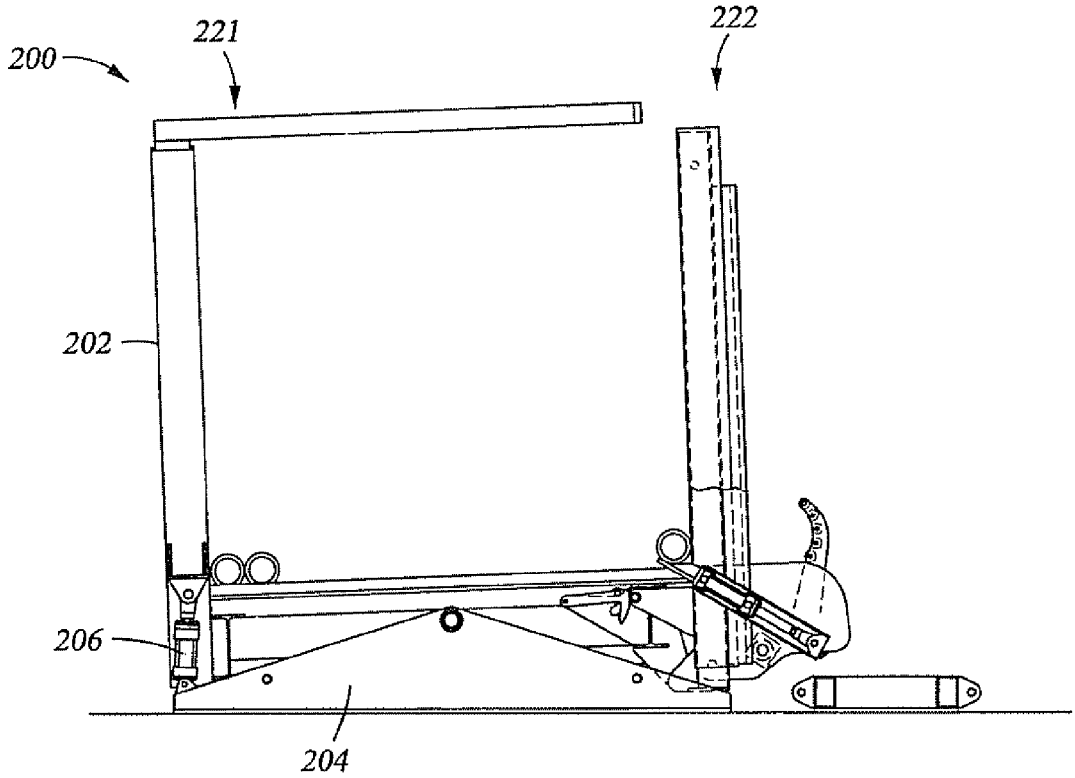
Figure 4F:
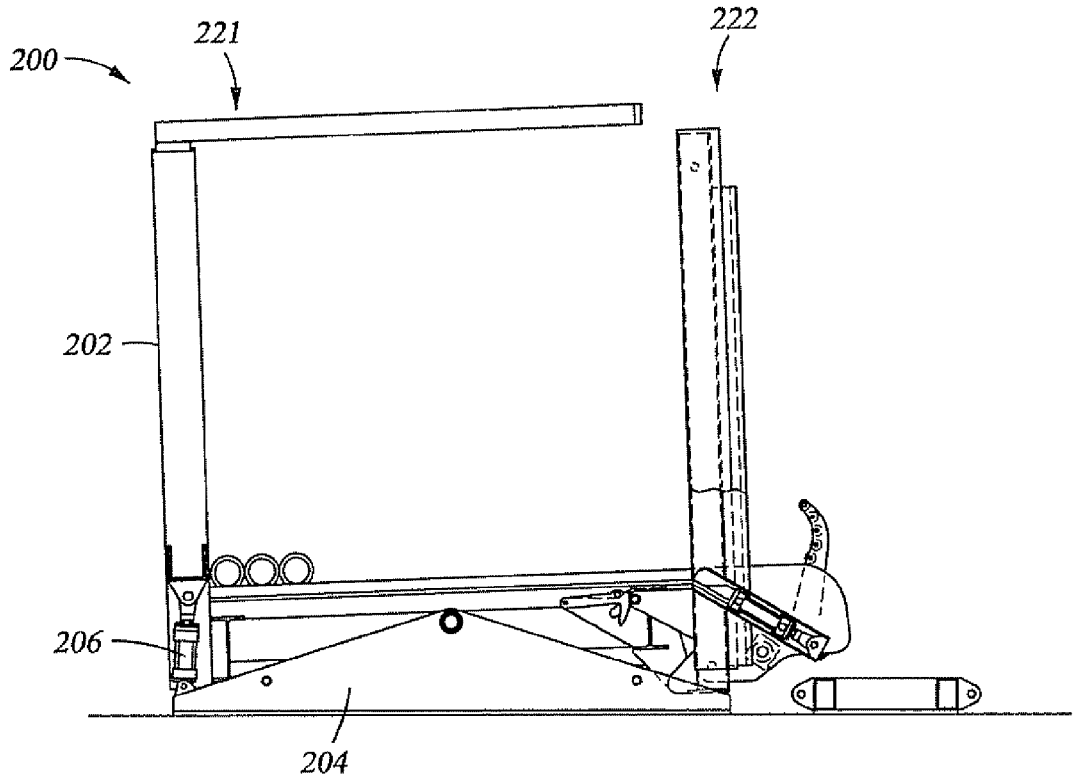
Figure 4G:
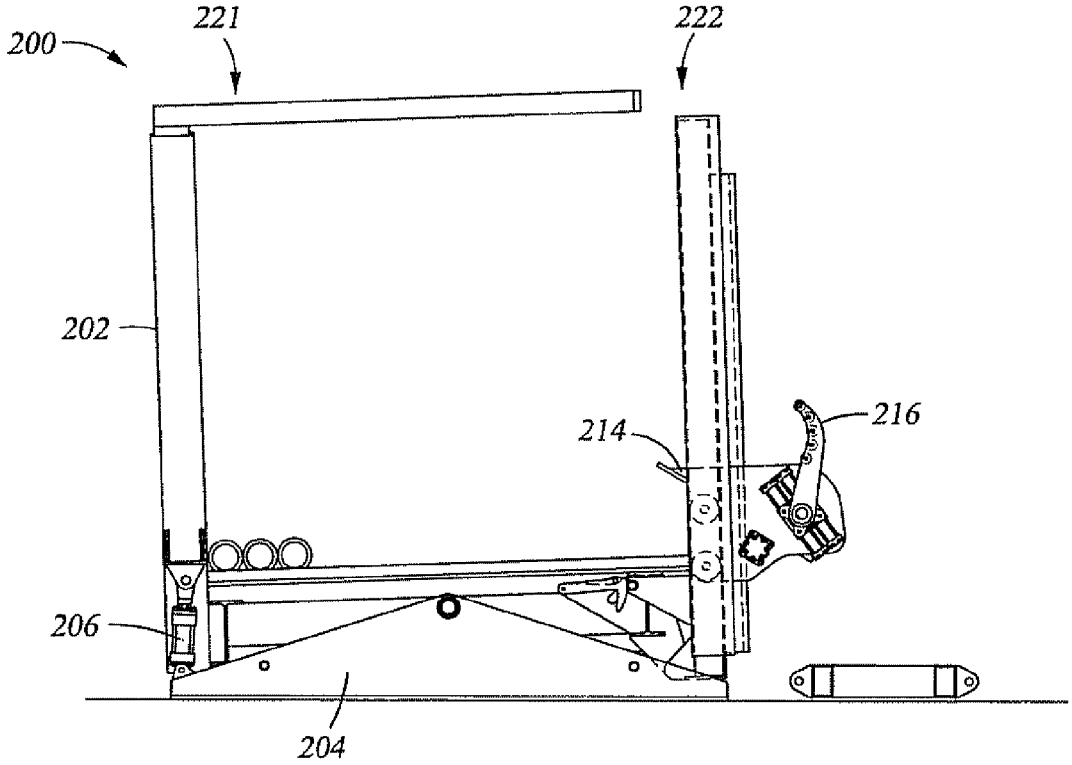
Figure 4H:
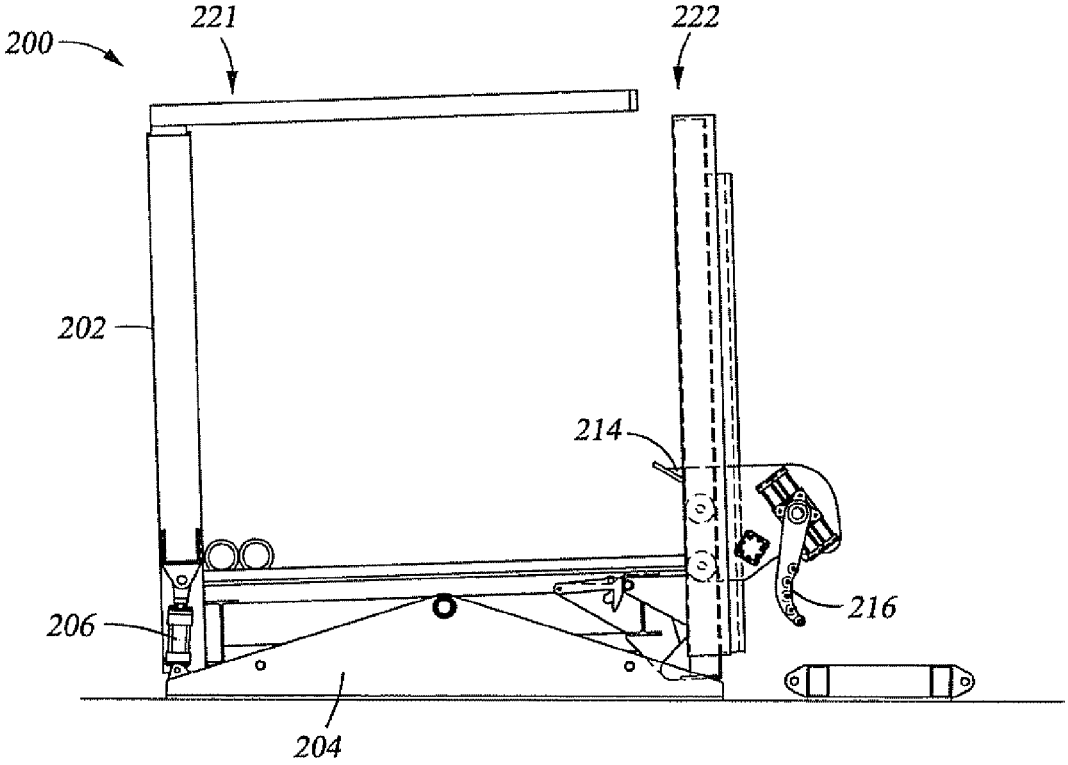

The unloading of pipe from handling system 200 is illustrated in FIGS. 3A-H. Piston 206 inclines frame 202 so that the frame is in a loading position where pipe joints 212 tend to move toward pipe moving assembly 210. Finger 214 extends to separate a single joint of pipe from the row of pipes stored in frame 202. Assembly 210 the moves upward until pipe 212 clears frame 202, as shown in FIG. 3B. Pipe 212 will roll down assembly 210 until it contacts arm 216, which is in an elevated position. With pipe 212 resting against arm 216, assembly 210 moves downward along frame 202 to the position shown in FIG. 3D. Motor 224 then rotates arm 216 so as to lower pipe 212 into erector system 400 and continues rotating until reaching a lowered position as shown in FIG. 3E. With arm 216 in a lowered position, erector system 400 can capture pipe 212 and move the pipe to the drill floor. Once erector system 400 has moved out of the way, assembly 210 is moved back to uppermost row of pipes and arm 216 is rotated back to the elevated position.

The loading of pipe from erector system 400 back into handling system 200 is illustrated in FIGS. 4A-H. Piston 206 inclines frame 202 so that pipe joints 212 tend to move away from moving assembly 210. Mover assembly 210 is disposed adjacent to erector system 400, once erector system 400 lowers pipe 212 to a horizontal position. Once erector system 400 disengages pipe 212, arm 216 rotates to lift pipe 212 from erector system 400. Mover assembly 210 then moves up frame 202 until pipe 212 clears the top of the frame. Once inside frame 202, pipe 212 is restrained by extended finger 214 and bumper 215. Mover assembly 210 moves back down frame 202 until pipe 212 is at the row of pipe being loaded. Finger 214 then retracts and pipe 212 will roll into position within frame 202. Mover assembly 210 is then moved back to the proper elevation to receive pipe from erector system 400 and arm 216 is rotated back to its lowered position.

Horizontal pipe handling systems can be used with a variety of pipe erectors and other pipe handling systems. For example, a horizontal pipe handling system may be utilized to move pipes onto and off of a pipe erector that moves the pipe from the horizontal storage position to a drill floor. Horizontal pipe handling systems can also be used with conventional pipe hoisting systems as well as other handling systems. Horizontal pipe handling systems may operate as separate components within a drilling system or be combined into an integrated system with a pipe erector or hoisting system. It is also understood that horizontal pipe handling systems can be used with a variety of oilfield tubulars, including drill pipe, drill collars, casing, and tubing.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

The invention claimed is:

1. A pipe handling system comprising:

a stationary frame;

a pipe rack moveably coupled to said frame and configured to support a plurality of pipes between a loading end and a storage end, wherein said pipe rack is moveable between a loading position where the loading end is positioned at a higher elevation than the storage end and an unloading position wherein the storage end is positioned at a higher elevation than the loading end;

a transfer arm rotatably coupled into the loading end of said rack; and an actuator having a power source, said actuator coupled to the loading end of said pipe rack and configured to rotate said transfer arm through 180 degrees of rotation to guide a single pipe between a position on said pipe rack and a position off of said pipe rack.

2. The pipe handling system of claim 1 further comprising a tilting mechanism coupled to said stationary frame and said pipe rack, wherein said tilting mechanism is operable to move said pipe rack from the loading position to the unloading position.

3. The pipe handling system of claim 1 further comprising a lifting mechanism coupled to said pipe rack and operable to separate a single pipe from the plurality of pipes on said pipe rack.

4. The pipe handling system of claim 3 wherein said lifting mechanism comprises a lifting block that pushes the single pipe upward and over an elevated stop disposed on said pipe rack.

5. The pipe handling system of claim 3 wherein said lifting mechanism comprises an extendable finger that engages the single pipe.

6. The pipe handling system of claim 1 wherein said arm rotates in a first direction of rotation when said pipe rack is in the loading position and in a second direction when said pipe rack is in the unloading position.

7. The pipe handling system of claim 1 wherein said actuator comprises a rotary motor coupled to and operable to rotate said arm.

8. The pipe handling system of claim 1 wherein said actuator comprises a linear actuator coupled to and operable to rotate said arm.

9. The pipe handling system of claim 1 wherein said rack comprises vertical members, wherein said arm is moveable along said vertical members.

10. The pipe handling system of claim 1 wherein said arm rotates in a plane transverse to a longitudinal axis of the pipe.

11. A pipe handling system comprising:

a pipe erector;

a stationary frame disposed adjacent to said pipe erector;

a pipe rack moveably coupled to said frame and configured to support a plurality of pipes between a loading end and a storage end, wherein said pipe rack is moveable between a loading position where the loading end is positioned at a higher elevation than the storage end and an unloading position wherein the storage end is positioned at a higher elevation than the loading end;

a transfer arm rotatably coupled into the loading end of said rack; and an actuator having a power source, said actuator coupled to the loading end of said pipe rack and configured to rotate said transfer arm through 180 degrees of rotation to guide a single pipe between a position on said pipe rack and a position on said pipe erector wherein said transfer arm is rotated past said pipe erector.

12. The pipe handling system of claim 11 further comprising a tilting mechanism coupled to said stationary frame and said pipe rack, wherein said tilting mechanism is operable to move said pipe rack from the loading position to the unloading position.

13. The pipe handling system of claim 11 further comprising a lifting mechanism coupled to said pipe rack and operable to separate a single pipe from the plurality of pipes on said pipe rack.

14. The pipe handling system of claim 13 wherein said lifting mechanism comprises a lifting block that pushes the single pipe upward and over an elevated stop disposed on said pipe rack.

15. The pipe handling system of claim 13 wherein said lifting mechanism comprises an extendable finger that engages the single pipe.

16. The pipe handling system of claim 11 wherein said arm rotates in a first direction of rotation when said pipe rack is in the loading position and in a second direction when said pipe rack is in the unloading position.

17. The pipe handling system of claim 11 wherein said actuator comprises a rotary motor coupled to and operable to rotate said arm.

18. The pipe handling system of claim 11 wherein said actuator comprises a linear actuator coupled to and operable to rotate said arm.

19. The pipe handling system of claim 11 wherein said rack comprises vertical members and wherein said arm is moveable along said vertical members.

20. The pipe handling system of claim 11 wherein said arm rotates in a plane transverse to a longitudinal axis of the pipe.

21. A pipe handling system comprising:

a stationary frame;

a pipe rack moveably coupled to said frame and configured to support a plurality of pipes between a loading end and a storage end, wherein said pipe rack is moveable between a loading position where the loading end is positioned at a higher elevation than the storage end and an unloading position wherein the storage end is positioned at a higher elevation than the loading end;

a tilting mechanism coupled to said storage end of said pipe rack and operable to move said pipe rack between the loading position and the unloading position; and a rotatable arm assembly mounted on the loading end of said pipe rack comprising:

a rotatable arm;

a gear coupled to said arm; and an actuator having a power source and configured to rotate said gear and said arm.

22. The pipe handling system of claim 21 further comprising a lifting mechanism coupled to said pipe rack and operable to separate a single pipe from the plurality of pipes on said pipe rack.

23. The pipe handling system of claim 22 wherein said lifting mechanism comprises a lifting block that pushes the single pipe upward and over an elevated stop disposed on said pipe rack.

24. The pipe handling system of claim 22 wherein said lifting mechanism comprises an extendable finger that engages the single pipe.

* * * * *